US008047137B2

(12) United States Patent
Blandon et al.

(10) Patent No.: US 8,047,137 B2
(45) Date of Patent: Nov. 1, 2011

(54) SAFETY SYSTEM FOR A SEAT OF A SKI LIFT FACILITY AND METHOD FOR IMPLEMENTING SAME

(76) Inventors: Noël Blandon, Bernin (FR); Christophe Tambourin, Saint Vincent de Mercuze (FR)

( * ) Notice: Subject to any disclaimer, the term of this patent is extended or adjusted under 35 U.S.C. 154(b) by 146 days.

(21) Appl. No.: 12/226,262

(22) PCT Filed: May 2, 2007

(86) PCT No.: PCT/FR2007/000753

§ 371 (c)(1),
(2), (4) Date: Oct. 14, 2008

(87) PCT Pub. No.: WO2007/135256

PCT Pub. Date: Nov. 29, 2007

(65) Prior Publication Data

US 2009/0243366 A1 Oct. 1, 2009

(30) Foreign Application Priority Data

May 24, 2006 (FR) ..... 06 04684

(51) Int. Cl.
*B61B 11/00* (2006.01)
*B60R 21/00* (2006.01)

(52) U.S. Cl. ..... 104/173.2; 297/465

(58) Field of Classification Search ..... 297/465, 297/485, 466, 464, 463.1, 463.2, 486, 487, 297/488; 335/219, 284, 291, 285, 289; 105/149.1, 105/149.2; 104/241, 283, 281
See application file for complete search history.

(56) References Cited

U.S. PATENT DOCUMENTS

| | | | | | |
|---|---|---|---|---|---|
| 3,089,064 | A | * | 5/1963 | De Bennetot | 361/147 |
| 3,645,480 | A | * | 2/1972 | Forman | 244/122 AG |
| 3,740,683 | A | * | 6/1973 | Benson | 335/284 |
| 3,783,794 | A | * | 1/1974 | Gopfert et al. | 104/283 |
| 3,978,441 | A | * | 8/1976 | Sobottka et al. | 335/284 |
| 4,784,065 | A | * | 11/1988 | Brochand | 104/173.2 |
| 5,038,128 | A | * | 8/1991 | Georgiev et al. | 335/290 |
| 5,715,539 | A | | 2/1998 | Benecki et al. | |
| 5,829,840 | A | * | 11/1998 | Goeckel | 297/464 |
| 6,288,623 | B1 | * | 9/2001 | Janzen | 335/291 |
| 6,494,145 | B2 | * | 12/2002 | Kernan | 105/149.1 |
| 6,702,242 | B1 | | 3/2004 | Ziaylek, Jr. et al. | |
| 2005/0214104 | A1 | * | 9/2005 | Strong | 414/546 |

FOREIGN PATENT DOCUMENTS

| | | | | |
|---|---|---|---|---|
| DE | 199 56 319 | A1 | | 6/2001 |
| FR | 2 801 553 | A1 | | 6/2001 |
| FR | 2 854 853 | A1 | | 11/2004 |
| GB | 24523 | | | 0/1911 |
| JP | 03038462 | A | * | 2/1991 |
| JP | 03148368 | A | * | 6/1991 |

* cited by examiner

*Primary Examiner* — Milton Nelson, Jr.
(74) *Attorney, Agent, or Firm* — Oliff & Berridge, PLC

(57) ABSTRACT

A safety system for a chair of a mechanical lift installation comprises a magnetic device able to occupy a retaining position of a passenger embarked on said chair when the chair is outside the unloading areas, and a released position when passing in an unloading area.

4 Claims, 3 Drawing Sheets

SAFETY SYSTEM FOR A SEAT OF A SKI LIFT FACILITY AND METHOD FOR IMPLEMENTING SAME

BACKGROUND OF THE INVENTION

The invention relates to a safety system for a chair of a mechanical lift installation comprising areas for loading and areas for unloading passengers on the chairs.

The invention also relates to a method for implementing the system according to the invention.

STATE OF THE ART

Different types of mechanical lifts, chair-lifts or others, present a plurality of chairs suspended in staggered manner on a carrying-hauling rope arranged in a closed loop. Each chair comprises a support cradle joined to the rope by means of rope grips. A restraining bar is fitted pivoting in the cradle between a lowered position and a raised position. The restraining bar is provided with a horizontal bar located in the lowered position above and in front of the seat of the chair.

To limit the risks of a passenger sliding off the chair, passenger protection devices have already been imagined comprising a series of protective members fixed to the horizontal bar of the restraining bar. Each protective member is salient in the downwards direction to be able to be placed between the passenger's legs when the restraining bar is pulled down to the lowered position. Such a device is for example described in the document FR-A-2801553.

A risk does exist of pinching the leg of a passenger who is not sitting properly on the seat, for example when he is in a position astride two seating places. To remedy this drawback, the document FR-A-2854853 proposes a protective device wherein each chair is equipped with a central stud located at the front of the central area so as to form a safety stop salient from the seating surface between the passenger's legs. In certain alternative embodiments, the central stud is fitted at the end of a rocker arm able to move between an inactive withdrawn position and an active safety position respectively when the seating place is unoccupied or occupied.

These different means for protecting against falls arranged between the bar of the cradle and the front part of the seat are not satisfactory. The protective members do not in fact provide any safety when the restraining bar is in the raised position. Moreover, with salient studs arranged fixedly in the seat of the chair, the safety level provided remains low as it is easy to straddle the studs if the restraining bar is not lowered. If the salient studs are designed to withdraw into the seat, it is clear that they do not provide any safety when the restraining bar is in the raised position. In all cases, these known means for protecting against falling remain inefficient when the restraining bar remains in the raised position outside the terminals, either by inadvertence or not.

OBJECT OF THE INVENTION

The object of the invention consists in providing a safety system for a chair of a mechanical lift installation providing improved passenger safety.

According to the invention, this object is achieved by the fact that the safety system comprises magnetic means able to occupy a retaining position of a passenger embarked on said chair when the chair is outside the unloading areas, and a released position when passing in an unloading area.

It can be easily understood that such a safety system for a chair prevents any forward sliding, whatever the position of the restraining bar, when the chair is outside the unloading areas, i.e. between the terminals and in the loading areas.

According to a preferred embodiment, the magnetic means comprise a magnetic part operating in conjunction with an element made of magnetic material, and control means to place the magnetic part in an attraction state of said element when the chair is outside the unloading areas, and in a released state of said element when passing in an unloading area.

The invention also relates to a method for implementing a safety system according to the invention wherein the passenger is equipped with an element made of magnetic material and is retained on the chair outside the unloading areas by magnetic attraction of said element and released from the chair when passing in an unloading area.

BRIEF DESCRIPTION OF THE DRAWINGS

Other advantages and features will become more clearly apparent from the following description of particular embodiments of the invention given for non-restrictive example purposes only and represented in the accompanying drawings, in which.

DESCRIPTION OF PREFERRED EMBODIMENTS

Figure 1:
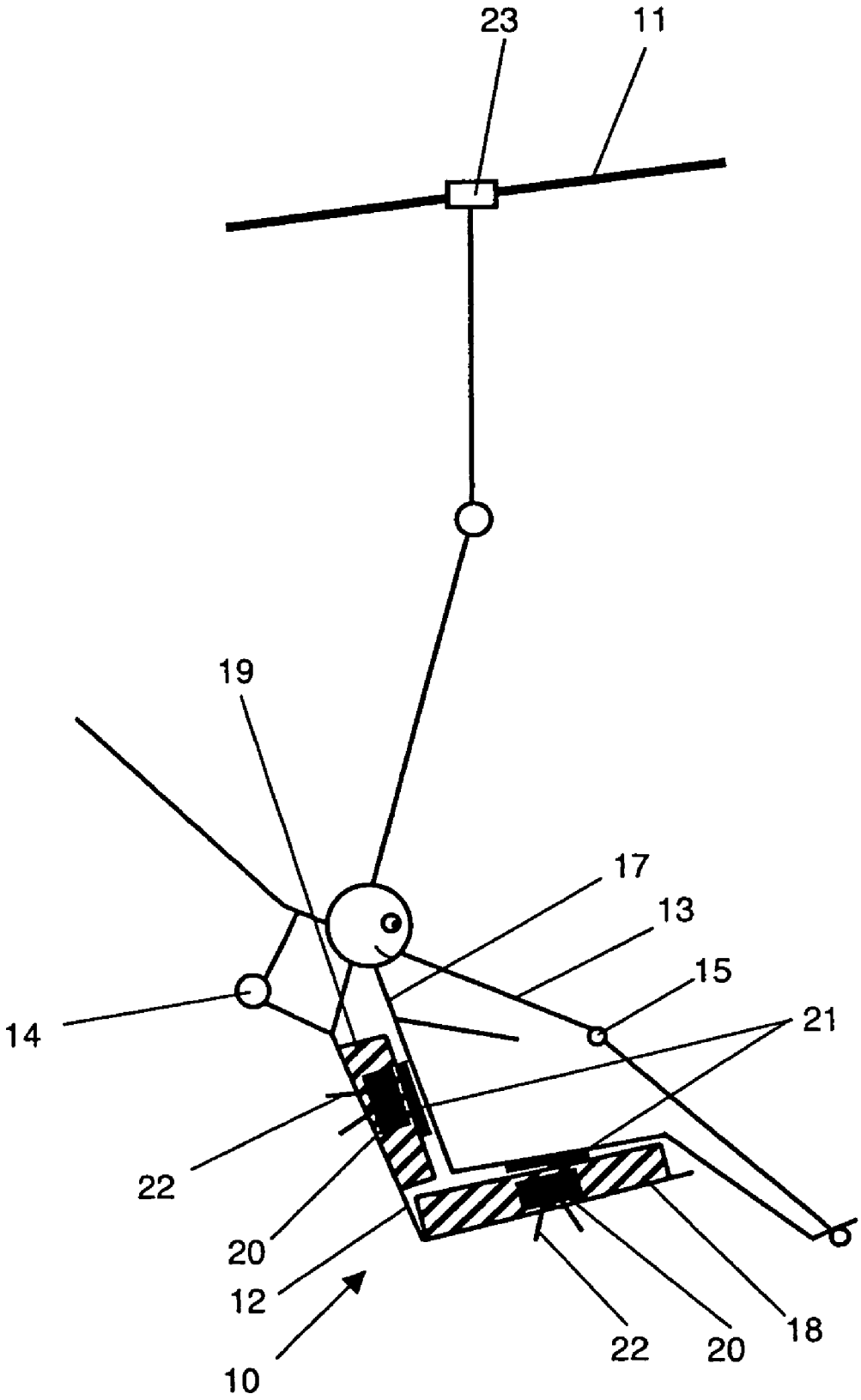
FIG. 1 is a schematic side view of a chair of a mechanical lift installation of chair-lift type equipped with a safety system according to the invention.

With reference to FIG. 1, each chair 10 of a mechanical lift installation of the chair-lift type is fixed in conventional manner to a carrying-hauling rope 11 by means of a support cradle 12 in the form of a frame supported by a grip 23. A safety restraining bar 13 is fitted pivoting on support cradle 12 at the level of an articulated joint 14 to vary between a lowered position (FIG. 1) and a raised position (not shown). Restraining bar 13 comprises a horizontal bar 15 placed in front of a passenger 17.

After passenger 17 has embarked on chair 10, restraining bar 13 is pulled down from the raised position to the lowered position so as to limit risks of an accidental frontwards fall when chair 10 is between two terminals having a passenger loading area and unloading area onto and off chairs 10. In this position (FIG. 1), bar 15 is placed above and in front of a seat 18 of chair 10, approximately at the level of the ventral part of the passengers. A gap remains between bar 15 of cradle 12 and the front part of seat 18 for the passengers to pass their legs through.

According to the invention, a backrest 19 of chair 10 integrates a magnetic part 20 operating in conjunction with an element 21 made of magnetic material worn by passenger 17, integrated in his clothing at the level of his back. Connecting wires 22, partially represented, connect magnetic part 20 to a current source (not shown) located in a terminal via a collecting device of contact slipper type provided for example at the level of grip 23. Magnetic part 20 and element 21 are integrated in the safety system according to the invention. What is meant by magnetic material is any material that is able to magnetize when it is immersed in an external magnetic field.

Figure 2:
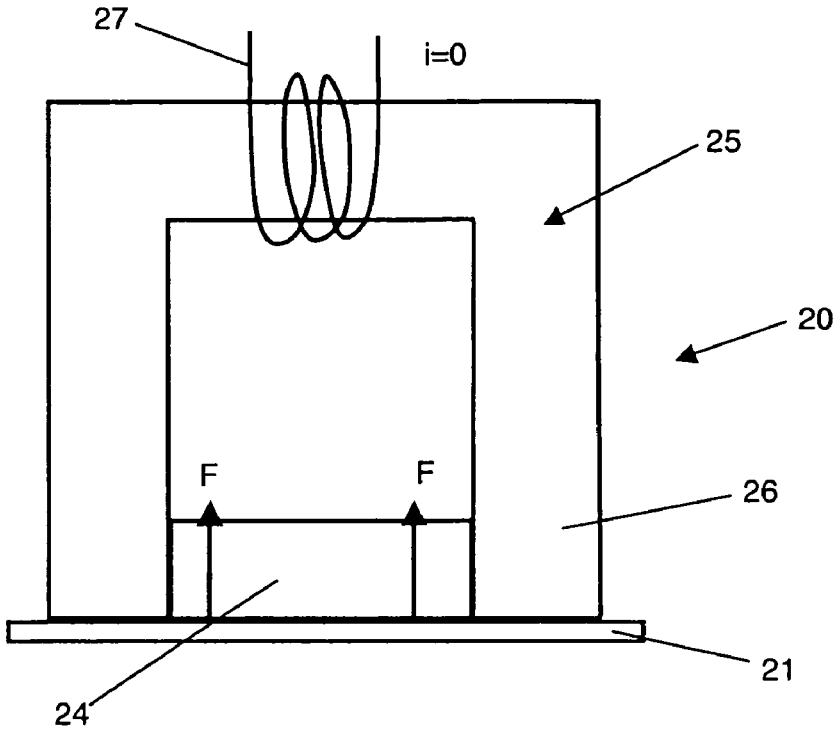
FIG. 2 is a schematic representation of a first example embodiment of the system of FIG. 1, in the retaining position.
Figure 3:
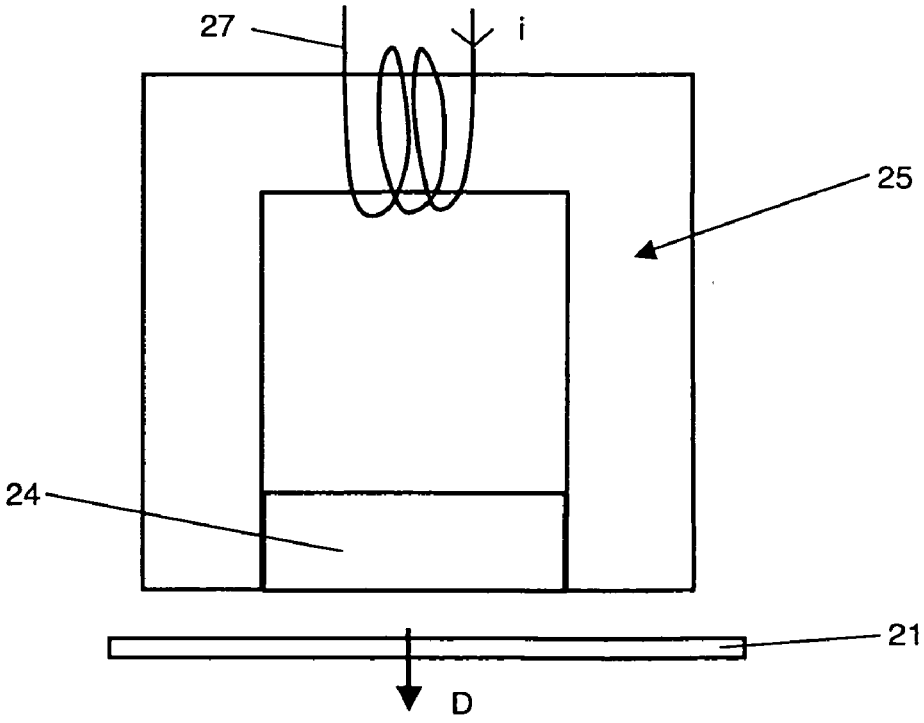
FIG. 3 illustrates the system of FIG. 2 in the released position.

FIGS. 2 and 3 schematically illustrate a first example of the safety system of FIG. 1. In this alternative embodiment, magnetic part 20 comprises a permanent magnet 24 and a electromagnet 25 composed of a U-shaped core 26 and an excitation coil 27 wound around the base of core 26. Permanent magnet 24 extends between the ends of the branches of core 26. Connecting wires 22 selectively supply excitation coil 27 with an operating current noted i. Magnetic part 20 is integrated in backrest 19 in such a way that permanent magnet 24 is facing magnetic material element 21 when passenger 17 is seated.

FIG. 2 illustrates the first example of the safety system when magnetic part 20 is placed in an attraction state, which state is commanded when chair 10 is located outside the unloading areas. Operating current i is zero and excitation coil 27 is not supplied. Permanent magnet 24, by generating a magnetic field expressed by attraction forces F, attracts magnetic material element 21. Embarked passenger 17 is firmly held in place via his or her back. The risks of passenger 17 accidentally falling by sliding frontwards under bar 15 are totally eliminated, whatever the position of restraining bar 13.

FIG. 3 represents the system of FIG. 2 when magnetic part 20 is placed in a released state, which state is commanded when chair 10 passes through an unloading area. The current source located in the terminal supplies excitation coil 27 with a non-zero operating current i via the collecting device and connecting wires 22, after passing through an on-board electronic filtering circuit if necessary. In known manner, excited electromagnet 25 generates a magnetic field compensating the magnetic field created by permanent magnet 24. Attraction forces F are nil and element 21 is released to be able to move in a direction of movement D away from backrest 19. Passenger 17 is released and can disembark.

Magnetic part 20 and magnetic material element 21 constitute magnetic means which are able to occupy a retaining position of a passenger 17 embarked on chair 10 when chair 10 is located outside the unloading areas, and a released position when passing in an unloading area.

Figure 4:
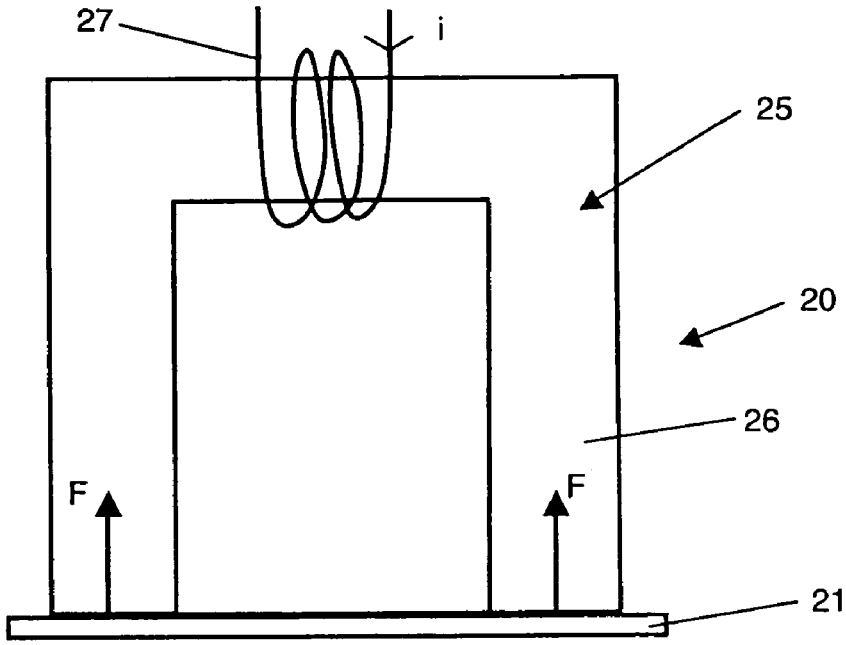
FIG. 4 is a schematic representation of a second example embodiment of the system of FIG. 1, in the retaining position.
Figure 5:
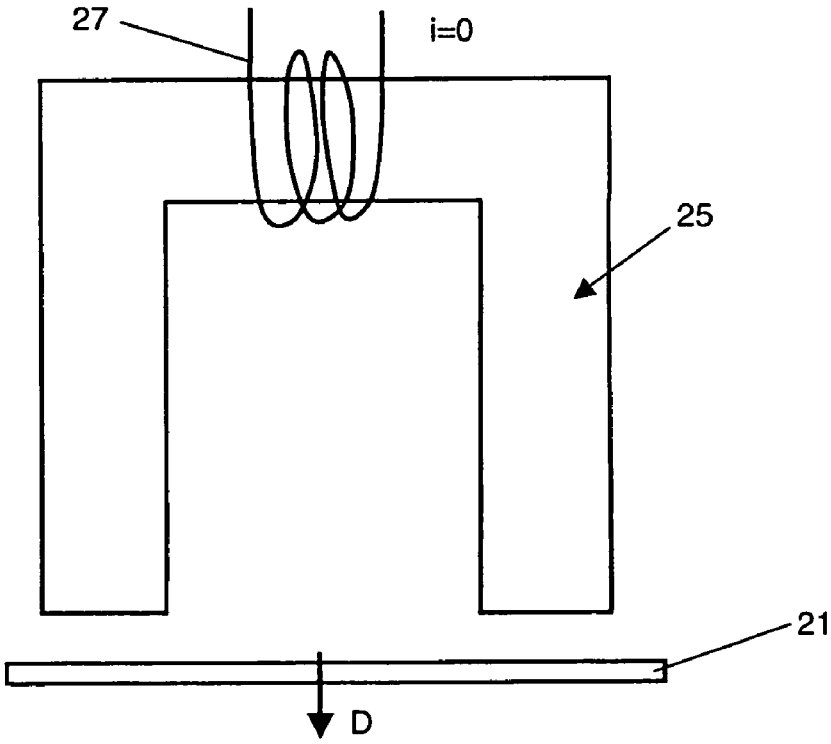
FIG. 5 illustrates the system of FIG. 4 in the released position.

FIGS. 4 and 5 illustrate a second example of a safety system wherein magnetic part 20 is modified. In this alternative embodiment, magnetic part 20 comprises an identical electromagnet 25 to that of FIGS. 2 and 3, but permanent magnet 24 is eliminated. Connecting wires 22 selectively supply excitation coil 27 with an operating current noted i. Magnetic part 20 is integrated in backrest 19 such that the ends of the branches of core 26 are facing magnetic material element 21. The current source is in this case located on-board chair 10 and includes rechargeable batteries and possibly an electronic processing circuit. Any means of recharging the batteries can be envisaged. The assembly is controlled by an in-board control unit (not shown). The collecting device is eliminated.

FIG. 4 illustrates the second example of a safety system when magnetic part 20 is placed in an attraction state, which state is commanded when chair 10 is located outside the unloading areas. On-board control unit controls the current source in such a way as to supply excitation coil 27 with a non-zero operating current i. Excited electromagnet 25 attracts magnetic material element 21, generating in known manner a magnetic field resulting in attraction forces F. Embarked passenger 17 is firmly secured via his or her back. The risks of passenger 17 accidentally falling by sliding forwards under bar 15 are totally eliminated, whatever the position of restraining bar 13.

FIG. 5 represents the system of FIG. 4 when magnetic part 20 is placed in a released state, which state is commanded when chair 10 passes into an unloading area. On-board control unit controls the current source in such a way as to cancel operating current i. In known manner, electromagnet 25 no longer generates a magnetic field. Attraction forces F are zero and element 21 is released to be able to move in a direction of movement D away from backrest 19. Passenger 17 is released and can disembark.

In the alternative embodiment of FIGS. 4 and 5, the control unit can dialogue, for example by radio, with transmitters or sensors located in the terminals so as to know the position of chair 10 (in an unloading area or not) at all times, or at least to know to which state magnetic part 20 has to be commanded.

In a non-represented alternative embodiment of the safety system, magnetic part 20 only comprises a permanent magnet 24 and electromagnet 25 is eliminated. In this case, permanent magnet 24 is fitted on the end of a rocker arm able to move between a position wherein it is separated from magnetic material element 21 with which it cooperates, and a position close to the latter, respectively when chair 10 is in an unloading area and outside the unloading areas. Movement from the close position to the separated position increases the air-gap separating permanent magnet 24 and magnetic material element 21 sufficiently to reduce or even eliminate the attraction forces F applied to element 21 when permanent magnet 24 is in the close position. In the opposite way, movement from the separated position to the close position reduces the air-gap sufficiently to generate large attraction forces F in the close position. The rocker arm movements are actuated by any suitable operating mechanism, for example mechanical or electrical.

Magnetic part 20 of the three alternative embodiments described hereabove can be integrated indifferently in seat 18 of chair 10. In this case, it is clear that magnetic material element 21 with which it cooperates is integrated in the clothing of passenger 17 at the level of his or her backside and/or thighs. Certain alternative embodiments present magnetic parts 20 at the same time in seat 18 and in backrest 19, as illustrated by FIG. 1.

In other alternative embodiments of the invention, magnetic part 20 of the three alternative embodiments described hereabove is worn by passenger 17 whereas magnetic material element 21 is integrated in chair 10. If magnetic part 20 uses an electromagnet 25, the current source generating operating current i, and also the associated control unit, are integrated in the clothing of passengers 17. The control unit then communicates, for example by radio, with transmitters our sensors located in the terminals so as to know the position of chair 10 (in an unloading area or outside the unloading areas) at all times, or at least to know to which state magnetic part 20 has to be commanded. If on the other hand magnetic part 20 only comprises a permanent magnet 25, magnetic material element 21 can be fitted on the end of a rocker arm able to move between a position wherein it is separated from permanent magnet 25 with which it cooperates, and a position close to the latter, respectively when chair 10 is in an unloading area and outside the unloading areas.

Any other equivalent means can be envisaged enabling magnetic means according to the invention to be constituted. In general manner, any technology enabling either the magnetic field created by a permanent magnet 24 to be compensated, or enabling this magnet to be demagnetized 24 for example from a specific electric power supply, can be used. Magnetic material element 21 can be integrated in the stitching of the fabric forming the clothing of passenger 17. The form of permanent magnet 24 and of electromagnet 25 can moreover vary provided that similar operation is preserved.

The invention covers all equipment, systems and mechanisms (mechanical, electronic, electric, radio . . . ) associated with magnetic part 20 and with element 21 for the latter to be able to operate according to the invention. Element 21 can be of any shape, advantageously ergonomic so as not to hamper passenger 17 when it is integrated in his or her clothing, and made from any suitable magnetic material (iron, cobalt, nickel, alloys of these magnetic materials, possibly with non-magnetic compounds). Finally, it is naturally possible to assign an individual safety system to each seating place of chair 10.

The invention claimed is:

1. A mechanical lift installation including passenger loading and unloading areas, the mechanical lift installation comprising:

a chair configured to receive a passenger; and a safety system configured to interact with a passenger embarked on the chair, the safety system comprising a magnetic device configured to operate in a retaining state and a releasing state, the retaining state being a state in which the magnetic device retains the passenger in the chair when the chair is outside the unloading areas, and the releasing state being a state in which the magnetic device releases the passenger from the chair when the chair is in the unloading areas, the magnetic device comprising:

a movable element made of ferromagnetic material; and a magnetic part configured to magnetically interact with the movable element and comprising:

a permanent magnet configured to generate a first magnetic field;

an electromagnet configured to generate a second magnetic field that cancels out the first magnetic field, the canceling out of the first magnetic field causing the magnetic device to operate in the releasing state; and a control unit configured to activate the electromagnet to generate the second magnetic field when the chair is in the unloading areas and deactivate the electromagnet when the chair is outside the unloading areas.

2. The mechanical lift installation according to claim 1, wherein the permanent magnet and the electromagnet are configured to cooperate with the movable element so that when the magnetic device is in the retaining state, the magnetic device is magnetically bonded to the movable element and when the magnetic device is in the releasing state, the magnetic device is not magnetically bonded to the movable element.

3. The mechanical lift installation according to claim 2, wherein the permanent magnet and the electromagnet are integral to the chair and the movable element is worn by the passenger.

4. The system according to claim 2, wherein the permanent magnet and the electromagnet are worn by the passenger and the movable element is integral to the chair.

* * * * *